US006889525B2

(12) United States Patent
Arnell

(10) Patent No.: US 6,889,525 B2
(45) Date of Patent: May 10, 2005

(54) RING AND MOUNTING FOR A PLURALITY OF GEMSTONES

(76) Inventor: Edward Roy Arnell, 810 Proserpine Road, Kelowna, British Columbia (CA), V1Z 1C7

( * ) Notice: Subject to any disclaimer, the term of this patent is extended or adjusted under 35 U.S.C. 154(b) by 0 days.

(21) Appl. No.: 10/248,783

(22) Filed: Feb. 18, 2003

(65) Prior Publication Data

US 2003/0154740 A1 Aug. 21, 2003

Related U.S. Application Data

(60) Provisional application No. 60/357,129, filed on Feb. 19, 2002.

(51) Int. Cl.[7] ..... A44C 17/02; A44C 9/00

(52) U.S. Cl. ..... 63/26; 63/15

(58) Field of Search ..... 63/26–31, 15–15.8; D11/3, 24–39

(56) References Cited

U.S. PATENT DOCUMENTS

| | | | | | |
|---|---|---|---|---|---|
| 35,744 | A | * | 7/1862 | Wittstein | 63/15 |
| 787,733 | A | * | 4/1905 | Dover | 63/28 |
| 881,802 | A | * | 3/1908 | Hunt | 63/30 |
| 1,308,011 | A | * | 6/1919 | Gilsey | 63/26 |
| 4,222,245 | A | | 9/1980 | Vitau | |
| 5,072,601 | A | * | 12/1991 | Slowinski | 63/28 |
| 5,084,108 | A | | 1/1992 | Kretchmer | |
| 5,188,679 | A | | 2/1993 | Kretchmer | |
| 5,520,017 | A | * | 5/1996 | Vivat | 63/29.1 |
| 6,003,335 | A | * | 12/1999 | Gurevich et al. | 63/26 |
| D432,938 | S | * | 10/2000 | Vardakis et al. | D11/26 |
| D445,057 | S | * | 7/2001 | Chanaratsopon et al. | D11/27 |
| D471,836 | S | * | 3/2003 | Chanaratsopon et al. | D11/27 |
| D472,496 | S | * | 4/2003 | Ambar | D11/34 |

FOREIGN PATENT DOCUMENTS

| | | | | |
|---|---|---|---|---|
| FR | 764966 | * | 5/1934 | 63/26 |

* cited by examiner

*Primary Examiner*—Robert J. Sandy
*Assistant Examiner*—Ruth C. Rodriguez
(74) *Attorney, Agent, or Firm*—Anthony C. Edwards

(57) ABSTRACT

A ring and mounting thereon for a plurality of gemstones includes a ring formed of a pair of shanks mounted together at a common end. The pair of shanks have a through-aperture between distal ends of the pair of shanks opposite the common end. The distal ends are entirely detached from each other. A first pair of upstanding flexible lever arms, or merely hereinafter arms, bracket opposite sides of the through-aperture. Each flexible arm has a base end and an opposite free end. Each flexible arm is mounted at its base end to a corresponding distal end of the shanks. A first gemstone forms a keystone mounted in compression sandwiched between the free ends of the first pair of upstanding flexible arms. A second pair of upstanding arms are mounted at their base ends to the pair of shanks so as to be disposed, one on each shank, on opposite sides of the first pair of upstanding flexible arms. A first pair of gemstone receiving pockets or cavities.

16 Claims, 8 Drawing Sheets

RING AND MOUNTING FOR A PLURALITY OF GEMSTONES

CROSS REFERENCE TO RELATED APPLICATIONS

This application claims priority from U.S. Provisional Patent Application No. 60/357,129 filed Feb. 19, 2002 entitled Multi Stone Tension Set Jewellery Ring.

BACKGROUND OF INVENTION

This invention relates to a mounting for multiple jewels or gemstones onto jewellery such as a finger ring, in a manner that achieves the greatest possible visual exposure of the jewel while achieving secure retention of the stones within the ring.

Gemstones have primarily been secured to a ring by a bezel or a series of claws, which girdle the stone. The unfortunate result is that although the stone is securely fastened to the ring it is also partially occluded, preventing the most advantageous visual presentation of the gemstone and its access to sufficient light rays for the illuminating the stone. Further, as wear occurs to the ring, the fastening devices often become snagged on garments or fabric with resultant loosening or breakage, which can result in the sudden loss of the gemstone. There has been developed in the past, a compression-mounting means for incorporating a single gemstone on a ring. In particular, applicant is aware of U.S. Pat. Nos. 5,084,108 and 5,188,679 which issued to Kretchmer on Jan. 28, 1992 and Feb. 23, 1993 respectively, both of which teach precious metal alloy compression-spring gemstone mounting wherein, a gemstone placed in the mounting is retained therein by the compressive spring force of the alloy. This prior art generally requires that the ring be opened, that is, formed as an incomplete circle or U-shape, which allows the adjacent ends of the ring to be slightly resiliently separated. The adjacent ring ends and/or the gemstone may be contoured so that when a stone is placed between resiliently separated ring ends, and the separated ring ends are permitted to assume their nearly closed aspect under the resilient compressive forces inherent to the ring, the gemstone is firmly secured in place. Similarly, the prior art teaches the resilient mounting of a gemstone between the overlapping ends of a ring formed as a helix.

SUMMARY OF INVENTION

The present invention includes a gemstone mount for a ring or other jewellery which permits a plurality of gemstones to be securely mounted thereon. In one aspect a plurality of gemstones may be mounted so as to position the upper surface of the gemstones in different horizontal planes. The gemstone mount includes a gemstone receiving aperture centered between the opposing open ends of a ring segment, which may be annular or helical, and at least one gemstone receiving pocket formed adjacent to the gemstone receiving aperture within the exterior face of the ring. The at least one gemstone receiving pocket may be first and second gemstone receiving pockets separated by opposing flexible lever arms integrally formed with or mounted to the ring so as to be upstanding therefrom. Inwardly opposing faces of opposed lever arms may be parallel. The lever arms are common between adjacent gemstone receiving pockets. The inwardly opposing faces may have gemstone-receiving seats formed therein.

The gemstone-receiving aperture is bracketed by a first pair of lever arms. The gemstone receiving pockets are formed in the exterior face of the ring in an adjacent array formed as a radially spaced sequence extending on either side of the gemstone receiving aperture. Again, in one embodiment, the opposed facing faces of the lever arms, between which are mounted the gemstones, may be parallel. However, in the ring embodiments, due to the radial spacing of adjacent gemstone receiving pockets about the center of curvature of the ring, the opposite faces of individual lever arms need not be parallel, but may be wedge-shaped.

Initially, gemstones are positioned in the outermost gemstone-receiving pockets, that is, the pockets in the array furthest from the gemstone receiving aperture, by slightly separating the adjacent pair of lever arms for that pocket and aligning a shoulder on the gemstone with opposed facing receiving seats in the lever arms. Where there are additional receiving pockets in the array, gemstones are inserted into these in sequence moving towards the gemstone receiving aperture until only the gemstone receiving aperture formed between the opposing open ends of the ring segment, is left unoccupied. By spreading apart the opposing pair of lever arms of the gemstone receiving aperture the last gemstone, which then functions as a keystone, may be inserted.

Adjacent gemstone-receiving pockets may be flanked by lever arms of unequal lengths to permit the aligned gemstone receiving seats within adjacent pockets to be located in dissimilar horizontal planes permitting the gemstones to also be secured at different horizontal planes.

The present invention may be characterized as a multi-stone set jewellery ring using a compressive force mounting provided by the slightly resilient shank of the ring to securely hold an adjacent array of stones. The shank may be of metal, advantageously titanium alloy. The central stone in the array of stones may be characterized as a keystone upon which the compressive pressure of the ring shank is brought directly to bear, the remaining adjacent stones on either side of the keystone in the array not being held solely by a compressive mount, but rather by the distribution of the compressive force bearing upon the keystone acting on the adjacent stones in the array by the flexing of thin flexible arms mounted to the shank and interleaved between adjacent stones in the array.

In a further aspect, the retentive force distributed from the compression mount of the keystone, and which is distributed outwardly from the keystone so as to retain adjacent stones between the flexible arms on the ends of the shank, is augmented by a force multiplying lever effect. The force multiplying lever effect is a result of the flexible arms holding the keystone being elevated at their ends above the height of the immediately adjacent stones so that when the keystone is mounted between the ends of the elevated pair of arms, a first compressive force brought to bear by the upper ends of the arms on the keystone is distributed to the adjacent stones through a bending moment applied to the arms supporting the keystone, thereby increasing the force distributed to the adjacent stones. The elevation of the keystone above the adjacent stones in the array, also has the effect of making the keystone more prominent and therefore perhaps more esthetically pleasing in its display on the ring.

In summary, the ring and mounting thereon for a plurality of gemstones includes a ring formed of a pair of shanks mounted together at a common end. The pair of shanks have a through-aperture between distal ends of the pair of shanks opposite the common end. The distal ends are entirely detached from each other. A first pair of upstanding flexible lever arms, or merely hereinafter arms, bracket opposite sides of the through-aperture. Each flexible arm has a base end and an opposite free end. Each flexible arm is mounted at its base end to a corresponding distal end of the shanks. A first gemstone forms a keystone mounted in compression sandwiched between the free ends of the first pair of upstanding flexible arms.

A second pair of upstanding arms are mounted at their base ends to the pair of shanks so as to be disposed, one on each shank, on opposite sides of the first pair of upstanding flexible arms. A first pair of gemstone receiving pockets or cavities are thereby formed adjacent to the keystone, on opposite sides of the first pair of upstanding flexible arms, between the second pair of upstanding arms and the first pair of upstanding flexible arms. Second and third gemstones are mounted in the first pair of gemstone receiving cavities in compression between the first pair of upstanding flexible arms and the second pair of upstanding arms. A reactive force acting outwardly of the keystone, that is, reactive to a compressive force on the keystone resulting from the compression of the keystone, is distributed via the first pair of upstanding flexible members as a distributed force acting in compression on the second and third gemstones.

The flexible arms of the first pair may be longer than each upstanding arm of the second pair of upstanding arms. The keystone may be mounted further from the base ends of the pair of upstanding flexible arms than the second and third gemstones so that the distributed force is higher than the reactive force. The keystone may be mounted closer to, or the same distance from the base ends of the first pair of upstanding flexible arms than the second and third gemstones.

In one embodiment, the second pair of upstanding arms are rigid buttressing arms resisting the distributed force. In another embodiment, the second pair of upstanding arms are flexible, and a third pair of upstanding arms are mounted at base ends thereof to the pair of shanks so as to be disposed, one on each the shank, on opposite sides of the second pair of upstanding arms so as to form a second pair of gemstone receiving cavities adjacent to the first pair of gemstone receiving cavities, on opposite sides of the second pair of upstanding arms, between the second and third pairs of upstanding arms. Fourth and fifth gemstones are mounted in the second pair of gemstone receiving cavities in compression between the second and third pairs of upstanding arms, so that the distributed force is distributed to the fourth and fifth gemstones via the second pair of upstanding arms. In such an embodiment, the third pair of upstanding arms may be the rigid buttressing arms resisting the distributed force acting on the fourth and fifth gemstones.

The opposed facing surfaces of the first pair of upstanding flexible arms may be concavely cupped to conformally mate with correspondingly shaped edges of the keystone. Oppositely disposed surfaces, opposite to the opposed facing surfaces, are concavely cupped in opposed facing relation to gemstone supporting surfaces of the second pair of upstanding arms supporting the second and third gemstones. The gemstone supporting surfaces are concavely cupped to conformally mate with correspondingly shaped edges of the second and third gemstones.

DETAILED DESCRIPTION

Figure 1:
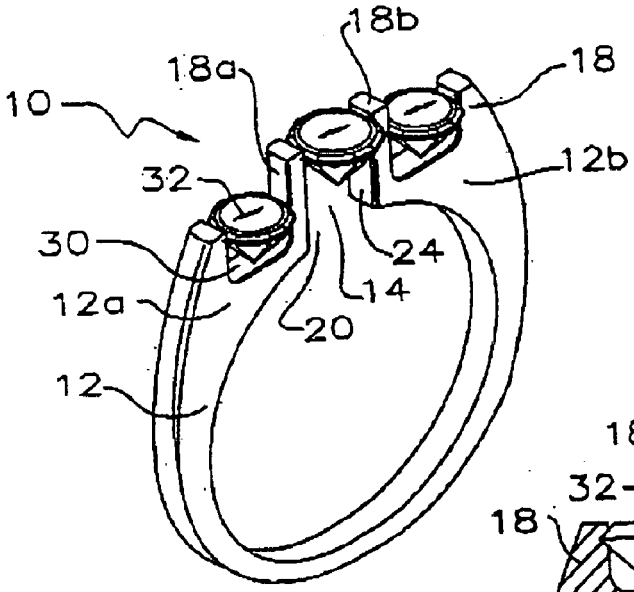
FIG. 1, is an isometric illustration of a ring according to one embodiment of the present invention.
Figure 1A:
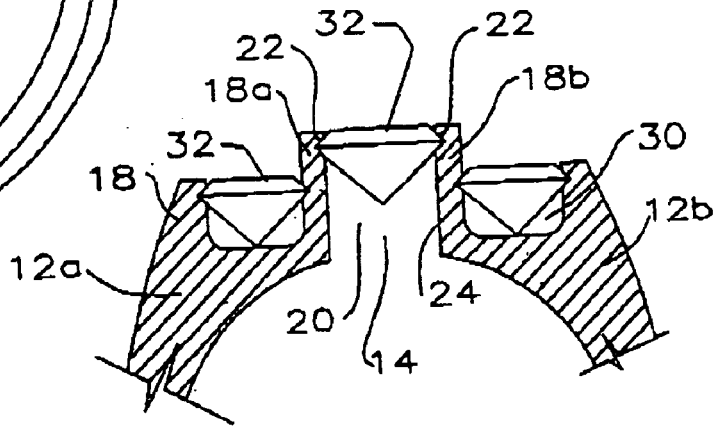
FIG. 1*a* is an enlargement of a portion of FIG. 2.

With reference to the drawing FIGS. 1–10, wherein similar characters of reference denote corresponding parts in each view, gemstone mount 10 as applied to jewelry such as a ring 12 requires that the ring be a segment, that is having a break 14 creating completely separate ring ends 12*a* and 12*b*. Break 14 is bracketed by opposing lever arms 18*a* and 18*b*, which create between them a gemstone-receiving aperture 20. Gemstone receiving seats 22 are formed within the inwardly facing opposing first faces 24 of lever arms 18. First faces 24 of lever arms 18 are generally parallel and seats 22 are formed in planar alignment across aperture 20.

Figure 2:
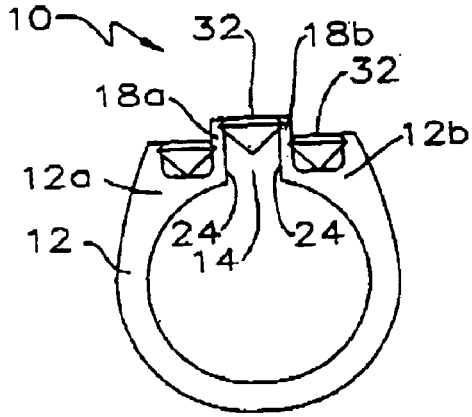
FIG. 2 is a side elevation of the ring of FIG. 1.
Figure 3:
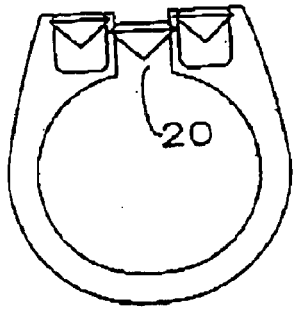
FIG. 3 is a side elevation of an alternative form of the ring.
Figure 4:
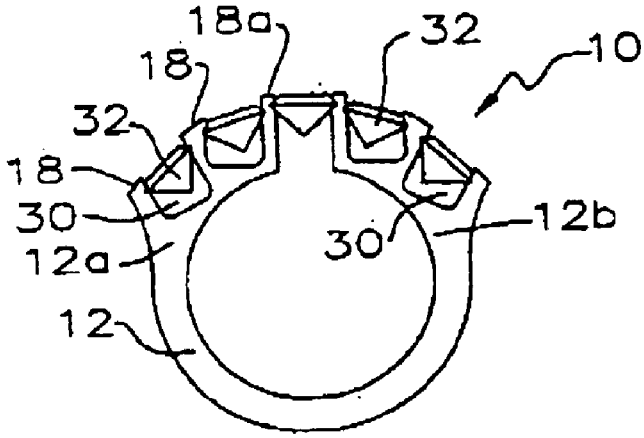
FIG. 4 is a side elevation of a further alternative form of the ring.
Figure 5:
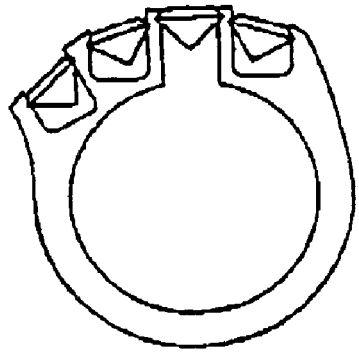
FIG. 5 is a side elevation of a further alternative form of the ring.
Figure 6:
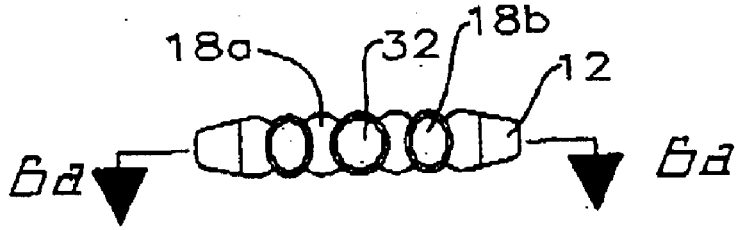
FIG. 6 is a plan view of one design of gemstone mounting.
Figure 6A:
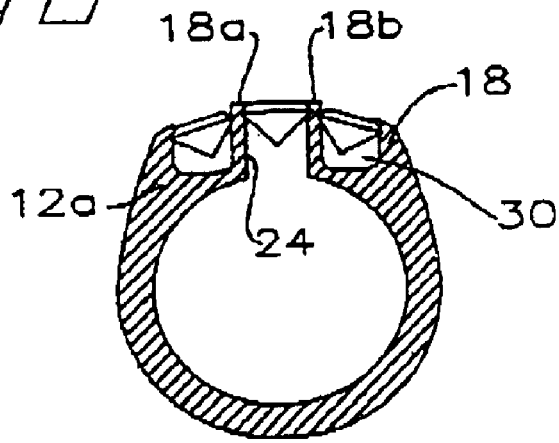
FIG. 6*a* is a side elevation of the ring and mounting illustrated in FIG. 6.
Figure 7:
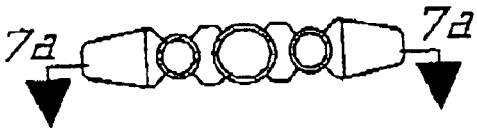
FIG. 7 is a plan view of an alternative design of gemstone mounting.
Figure 8:
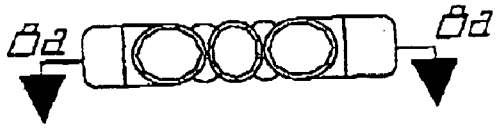
FIG. 8 is a plan view of an alternative design of gemstone mounting.
Figure 7A:
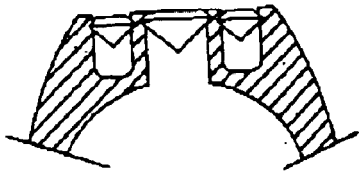
FIG. 7*a* is a side elevation of the ring and mounting illustrated in FIG. 7.
Figure 8A:
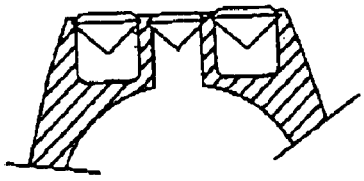
FIG. 8*a* is a side elevation of the ring and mounting illustrated in FIG. 8.
Figure 9:
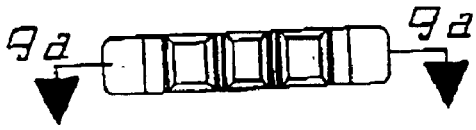
FIG. 9 is a plan view of an alternative design of gemstone mounting.
Figure 10:
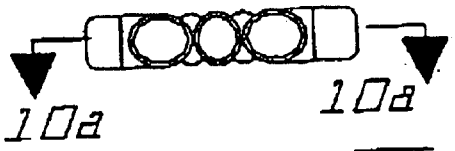
FIG. 10 is a plan view of an alternative design of gemstone mounting.
Figure 9A:
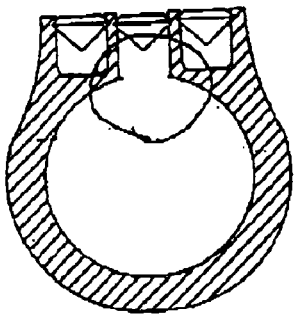
FIG. 9*a* is a side elevation of the ring and mounting illustrated in FIG. 9.
Figure 10A:
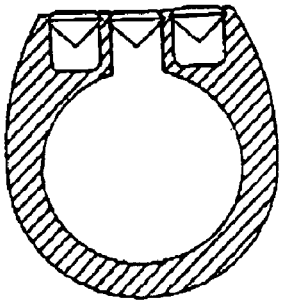
FIG. 10*a* is a side elevation of the ring and mounting illustrated in FIG. 10.
Figure 11:
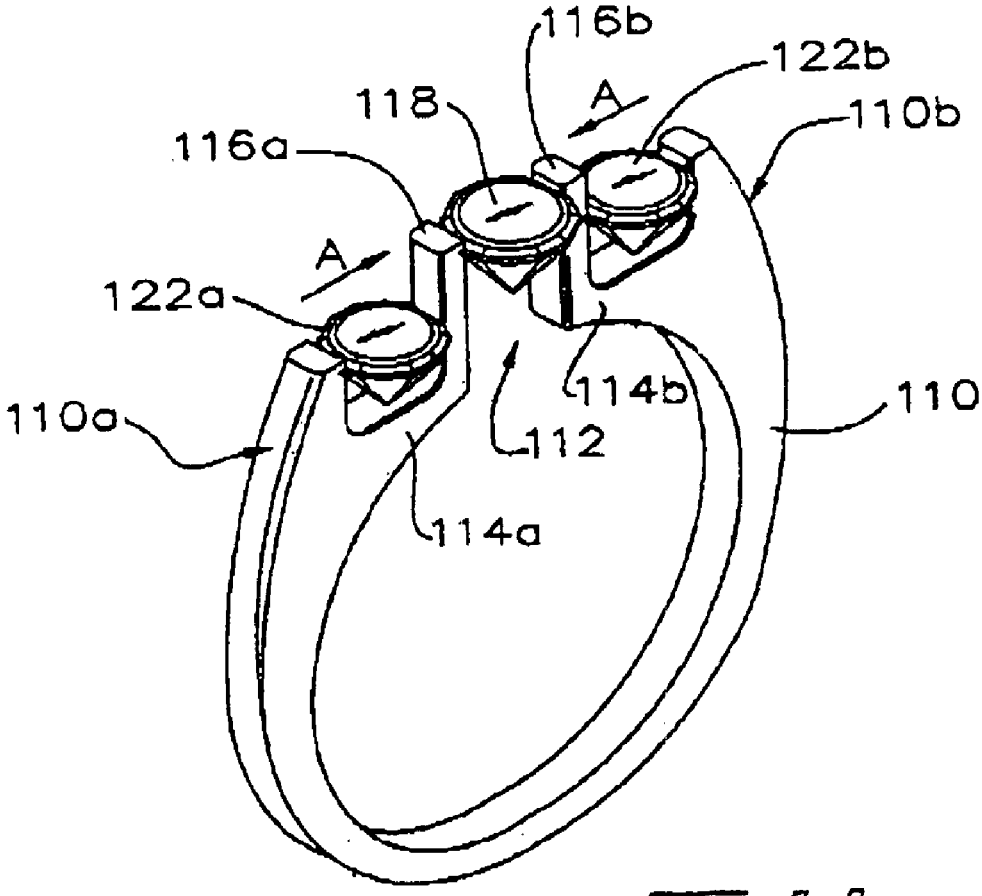
FIG. 11 is, in perspective view, one embodiment of the tension mount for multiple gemstones according to the present invention.

Additional gemstone receiving pockets 30 are formed in a radially spaced sequence along the exterior face of ring 12 adjacent to gemstone-receiving aperture 20. As illustrated in FIG. 2, for example, the ring design may position gemstones 32 within receiving pockets 30 in a horizontal aspect where the exposed upper surface of each gem is maintained substantially coplanar. Alternatively, as illustrated in FIG. 4, the gemstones may be positioned in a radial aspect about the center of curvature of the ring segment so that the exposed upper surfaces of gemstones 32 are with each other non-coplanar. Lever arms 18 may differ in height as illustrated in FIGS. 2, 4 and 6*a* permitting the gemstone receiving seats 22 to be positioned appropriately for the designed alignments of the gemstones, whether coplanar or non-coplanar.

Each gemstone-receiving pocket 30 has one lever arm in common with an adjacent pocket. The pockets 30 flanking aperture 20 have lever arms 18*a* and 18*b* common between them. Slight flexure of the lever arms facilitates gemstone insertion within a pocket but exerts less than the preferred holding compression upon the gemstone within that pocket. The spreading apart of opposing lever arms 18*a* and 18*b* for keystone insertion distributes an additional compressive force acting on all gemstones in the array of gemstones.

With reference to the drawing FIGS. 11–20, wherein again similar characters of reference denote corresponding parts in each view, the ring according to the present invention includes a shank 110 having ends 110*a* and 110*b* so as to define therebetween a through-gap 112.

Ends 110*a* and 110*b* are formed in all embodiments to include a pair of opposed facing, inwardly disposed cantilevered base arms 114*a* and 114*b*. A generally parallel pair of flexible metal arms, which may be resilient, are mounted at their lower ends to the inner most ends of base arms 114*a* and 114*b* respectively so that flexible arms 116*a* and 116*b* extend vertically cantilevered from the ends of base arms 114*a* and 114*b*.

A keystone 118, which may be any variety of gemstone, is mounted in a compression-spring mount between the upwardly cantilevered ends of flexible arms 116*a* and 116*b*. Thus, keystone 118 is suspended within through-gap 112 merely by the resilient compressive force A exerted by arms 116*a* and 116*b* on opposite edges of keystone 118 as shank 110 urges the flexible arms together, keystone 118 maintaining shank 110 in a slightly resiliently deformed shape with ends 110*a* and 110*b* slightly spread apart from their non-deformed state.

Figure 12:
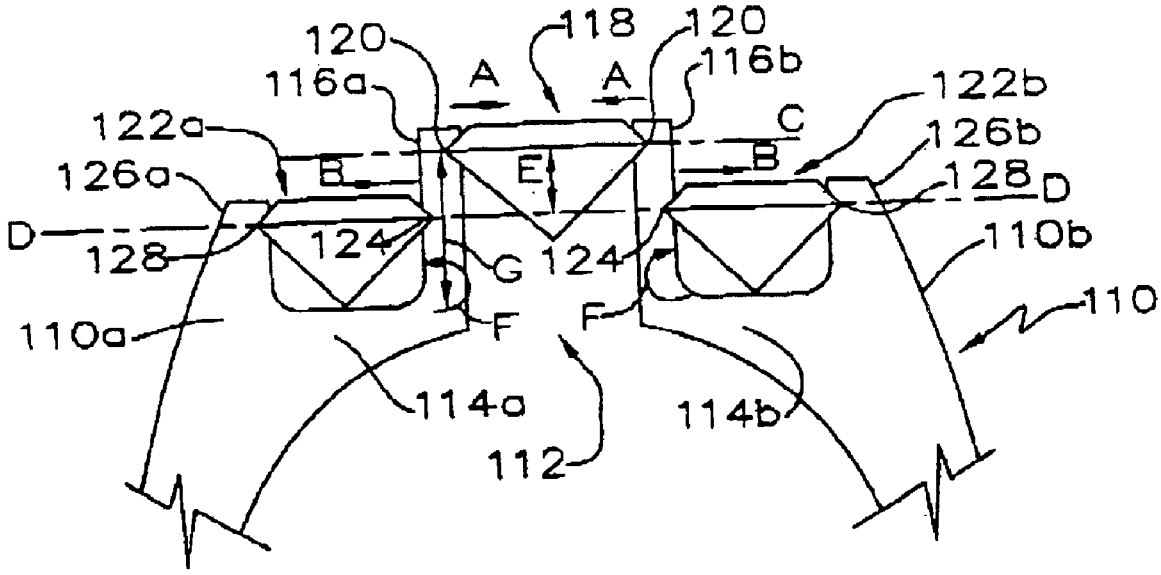
FIG. 12 is, in front elevation partially cut away view, the embodiment of FIG. 11.
Figure 13:
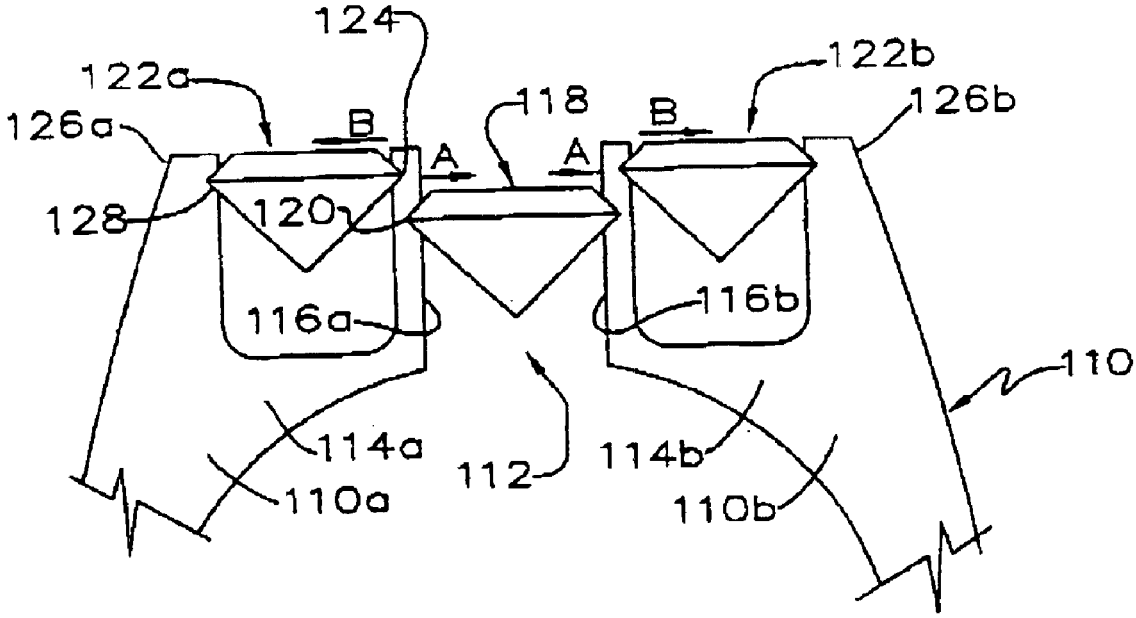
FIG. 13 is, in front elevation partially cut away view, a second embodiment of the tension mount for multiple gemstones according to the present invention.

In one embodiment, the opposite edges of keystone 118 are maintained in contact with flexible arms 116*a* and 116*b* by a mating of the edges into corresponding parallel grooves 120 formed in the opposed facing surfaces of flexible arms 116*a* and 116*b* on opposite sides of through gap 112, as better seen in FIGS. 12 and 13.

In every embodiment, at least one adjacent gemstone 122*a* or 122*b* is mounted snugly up against the sides of flexible arms 116*a* and 116*b* opposite from gemstone 118 so as to form an array, which may be linear, of gemstones held in spaced apart array and, in one embodiment centered by keystone 118. Because flexible arms 116*a* and 116*b* are thin and therefore slightly flexible or slightly resiliently flexible, the compressive force A of the compression-spring mount of keystone 118 is distributed through flexible arms 116*a* and 116*b* so as to act in opposite directions B on the edges of adjacent gemstones 122*a* and 122*b* which are mounted up against flexible arms 116*a* and 116*b* respectively. Again, adjacent gemstones 122*a* and 122*b* may be mounted within parallel grooves 124 formed in the oppositely disposed surfaces of flexible arms 116*a* and 116*b*.

Movement of adjacent gemstones 122*a* and 122*b* relative to cantilevered base arm 114*a* and 114*b* above which they are mounted, is resisted by buttresses 126*a* and 126*b* common to all embodiments and formed integrally with shank ends 110*a* and 110*b*. Grooves 128 may be formed in buttresses 126*a* and 126*b* in opposed facing relation to corresponding grooves 124 in flexible arms 116*a* and 116*b* for the mating therein of opposite edges of adjacent gemstones 122*a* and 122*b* in a compression friction mount.

In the embodiment of FIG. 12, flexible arms 116*a* and 116*b* are sufficiently long so that keystone 118 may be mounted in through-gap 112 suspended between grooves 120 in plane C spaced apart from, and in this embodiment above, a plane D containing grooves 124 and 128. Planes C and D are spaced apart by a distance E so that the reactive force of keystone 118 acting on flexible arms 116*a* and 116*b* equally and oppositely to compression force A, creates bending moments F acting about the bases of flexible arms 116*a* and 116*b* where they are joined to base arms 114*a* and 114*b*, the bases of the flexible arms functioning similarly to fulcrums as flexible arms 116*a* and 116*b* are pivoted in opposite directions by the reactive force in plane C of keystone 118. The reactive force in plane C, acting along a moment arm G thereby imparts a force in plane D, compression force B, which is greater than the reactive force acting in plane C by the operation of arms 116*a* and 116*b* as lever arms, wherein the force multiplier effect is a function of the ratio G/(G–E). Thus for a given compression force A acting on keystone 118 by reason of the compression-spring mounting of keystone 118, in the embodiment of FIG. 12 wherein keystone 118 is elevated above adjacent gemstones 122*a* and 122*b*, a greater compression force B is obtained acting on the adjacent gemstones resulting in a stronger compression fit. In the embodiment of FIG. 13, the mechanical advantage of flexible arms 116*a* and 116*b* acting as force multiplying lever arms is lost, and in effect lessened so that, for a given compression force A, the corresponding compression forces B acting on the adjacent gemstones is less. Nevertheless, given a sufficiently large compression force A, a sufficient compression force B may be obtained so as to securely hold adjacent gemstones 122*a* and 122*b* while obtaining an unusual appearance to the array wherein the keystone, rather than being elevated, is recessed within the compression-spring mount.

Figure 14:
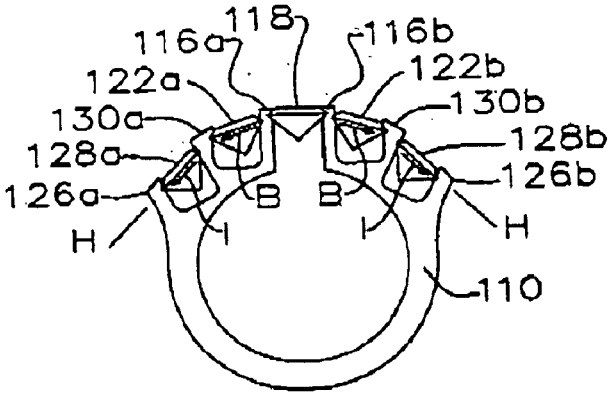
FIG. 14 is, in front elevation view, a further embodiment of the present invention.
Figure 15:
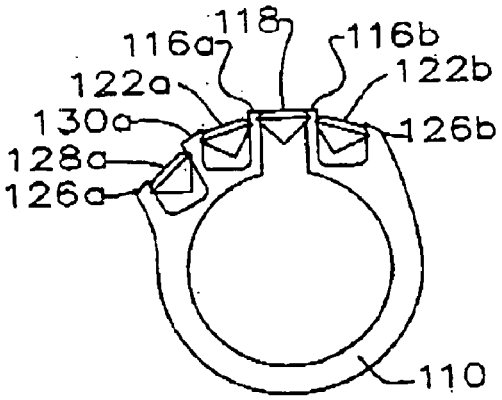
FIG. 15 is, in front elevation view, a further embodiment of the present invention.
Figure 16:
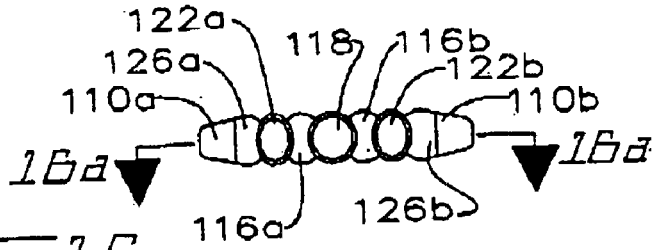
FIG. 16 is, in plan view, a further embodiment of the present invention.
Figure 16A:
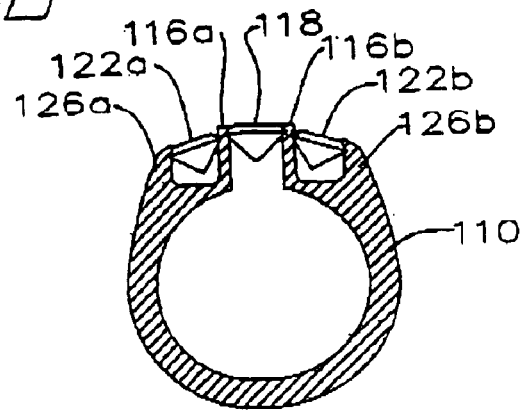
FIG. 16*a* is a sectional view along line 16*a*—16*a* in FIG. 16.
Figure 17:
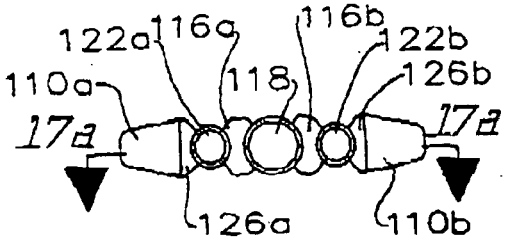
FIG. 17 is, in plan view, a further alternative embodiment of the present invention.
Figure 18:
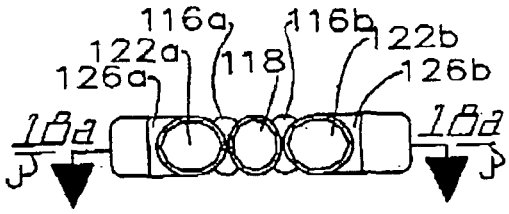
FIG. 18 is, in plan view, a further alternative embodiment of the present invention.
Figure 17A:
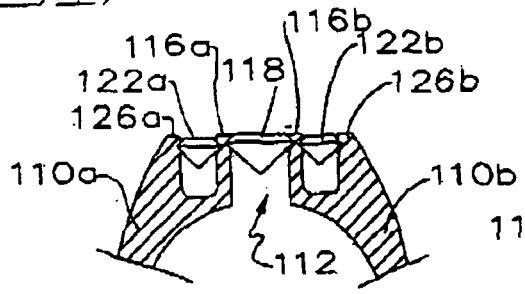
FIG. 17*a* is a sectional view along line 17*a*—17*a* in FIG. 17.
Figure 18A:
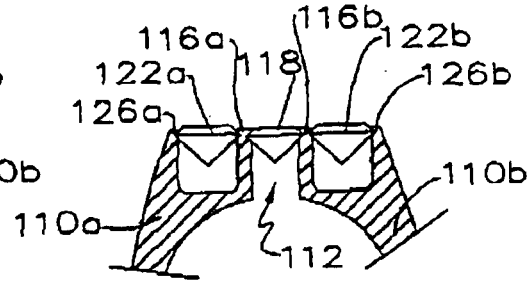
FIG. 18*a* is a sectional view along line 18*a*—18*a* in FIG. 18.
Figure 19:
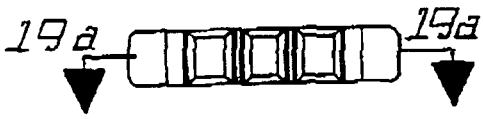
FIG. 19 is, in plan view, a further alternative embodiment of the present invention.
Figure 20:
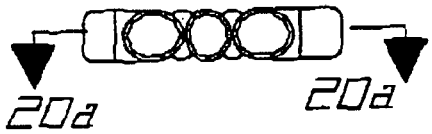
FIG. 20 is, in plan view, a further alternative embodiment of the present invention.
Figure 19A:
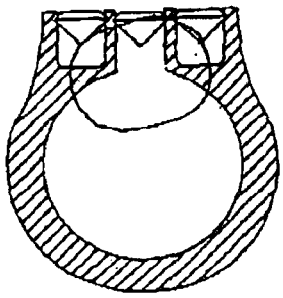
FIG. 19*a* is a sectional view along line 19*a*—19*a* in FIG. 19.
Figure 20A:
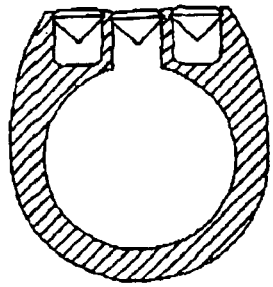
FIG. 20*a* is a sectional view along line 20*a*—20*a* in FIG. 20.

In the embodiment of FIG. 14, the array of gemstones including keystone 118 includes a further adjacent pair of adjacent gemstones 128*a* and 128*b*, wherein the array is linear in a plane containing the entire shank 110 but curves along a curved or arcuate surface H, the physical principles enunciated above with respect to FIGS. 12 and 13 also applying to the compression mounting of keystone 118 and adjacent gemstones 122*a* and 122*b*. In the embodiment of FIG. 14 however a further pair of flexible arms 130*a* and 130*b* are interleaved between adjacent gemstones 122*a* and 122*b* and adjacent gemstones 128*a* and 128*b* respectively. The result is a cascading effect distributing the reactive force which is equal and opposite to the compression force A in plane C so as to distribute firstly compression force C outwardly from keystone 118 via flexible arms 116*a* and 116*b*, and then further distributing the force outwardly via adjacent gemstones 122*a* and 122*b* to flexible arms 130*a* and 130*b* and then to adjacent gemstones 128*a* and 128*b* so as to securely mount adjacent gemstones 128*a* and 128*b* against buttresses 126*a* and 126*b*. Thus, similarly, in the embodiment of FIG. 15, the distributed reactive force to the compression force A is asymmetrically cascaded, on one side, through flexible arm 116*a*, adjacent gemstone 122*a*, flexible 130*a*, and adjacent gemstone 128*a* so as to securely sandwich adjacent gemstones 128*a* and 122*a* between buttress 126*a*, and flexible arms 130*a* and 116*a* respectively. On the opposite side of keystone 118, merely adjacent gemstone 122*b* is mounted between flexible arm 116*b* and buttress 126*b*.

In the embodiments of FIGS. 16–20, and their corresponding sectional views in FIGS. 16*a*–20*a*, the opposed facing surfaces of the flexible arms, for example, those of flexible arms 116*a* and 116*b*, are curved so as to follow the rounded circumference or perimeter of the gemstone being supported, be it keystone 118, or adjacent gemstones 122*a*, 122*b*, 128*a* or 128*b*. In this fashion, gemstones having various shapes, whether they be round or elliptical and whether they be oriented with the long axis lying in the plane J which contains the ring shank 110 or oriented orthogonally to plane J, may be snugly and securely supported while still employing the compression-spring mount of keystone 118 and the cascading distributed compression mounting of adjacent gemstones in the array. As may be seen, in the embodiments including those of FIGS. 17–20, the array of gemstones are not only linear but also substantially planar across their upper surfaces so that planes C and D are coincident.

As will be apparent to those skilled in the art in the light of the foregoing disclosure, many alterations and modificaare possible in the practice of this invention without departing from the spirit or scope thereof. Accordingly, the scope of the invention is to be construed in accordance with the substance defined by the following claims.

What is claimed is:

1. A ring and a mounting thereon for a plurality of gemstones comprising:

a ring segment having a break creating completely separate ring ends, said ring ends forming a pair of shanks, said break extending between distal ends of said pair of shanks wherein said distal ends are entirely detached from each other, a pair of upstanding flexible arms bracketing opposite sides of said break, each flexible arm of said pair of upstanding flexible arms having a base end and an opposite free end, each said flexible arm mounted at its base end to a corresponding distal end of said distal ends of said pair of shanks, a first gemstone forming a keystone mounting in compression sandwiched between said free ends of said pair of upstanding flexible arms, wherein the compression is solely due to compression of said ring ends by the resilient biasing of said ring segment urging said ring ends together and acting on said first gemstone solely via said pair of upstanding flexible arms, a second pair of upstanding arms mounted at base ends thereof to said pair of shanks so as to be disposed, one on each said shank, on opposite sides of said pair of upstanding flexible arms so as to form a first pair of gemstone receiving cavities adjacent to said keystone, on opposite sides of said pair of upstanding flexible arms, between said second pair of upstanding arms and said pair of upstanding flexible arms, second and third gemstones mounted in said first pair of gemstone receiving cavities in compression between said pair of upstanding flexible arms and said second pair of upstanding arms, wherein a reactive force acting outwardly of said keystone, reactive to a compressive force on said keystone resulting from said compression of said keystone, is distributed via said pair of upstanding flexible members as a distributed force acting in compression on said second and third gemstones.

2. The device of claim 1 wherein said second pair of upstanding arms are rigid buttressing arms resisting said distributed force.

3. The device of claim 1 wherein each said flexible arm is longer than each upstanding arm of said second pair of upstanding arms.

4. The device of claim 3 wherein said keystone is mounted further from said base ends of said pair of upstanding flexible arms than said second and third gemstones so that said distributed force is higher than said reactive force.

5. The device of claim 4 wherein said second pair of upstanding arms are rigid buttressing arms resisting said distributed force.

6. The device of claim 4 wherein said second pair of upstanding arms are flexible, and wherein a third pair of upstanding arms are mounted at base ends thereof to said pair of shanks so as to be disposed, one on each said shank, on opposite sides of said second pair of upstanding arms so as to form a second pair of gemstone receiving cavities adjacent to said first pair of gemstone receiving cavities, on opposite sides of said second pair of upstanding arms, between said second and third pairs of upstanding arms, and wherein fourth and fifth gemstones are mounted in said second pair of gemstone receiving cavities in compression between said second and third pairs of upstanding arms, wherein said distributed force is distributed to said fourth and fifth gemstones via said second pair of upstanding arms.

7. The device of claim 4 wherein said third pair of upstanding arms are rigid buttressing arms resisting said distributed force acting on said fourth and fifth gemstones.

8. The device of claim 4 wherein opposed facing surfaces of said pair of upstanding flexible arms are concavely cupped to conformally mate with correspondingly shaped edges of said keystone.

9. The device of claim 8 wherein oppositely disposed surfaces, opposite to said opposed facing surfaces, are concavely cupped in opposed facing relation to gemstone supporting surfaces of said second pair of upstanding arms supporting said second and third gemstones, and wherein said gemstone supporting surfaces are concavely cupped to conformally mate with correspondingly shaped edges of said second and third gemstones.

10. The device of claim 3 wherein said keystone is mounted closer to said base ends of said pair of upstanding flexible arms than said second and third gemstones.

11. The device of claim 10 wherein said second pair of upstanding arms are flexible, and wherein a third pair of upstanding arms are mounted at base ends thereof to said pair of shanks so as to be disposed, one on each said shank, on opposite sides of said second pair of upstanding arms so as to form a second pair of gemstone receiving cavities adjacent to said first pair of gemstone receiving cavities, on opposite sides of said second pair of upstanding arms, between said second and third pairs of upstanding arms, and wherein fourth and fifth gemstones are mounted in said second pair of gemstone receiving cavities in compression between said second and third pairs of upstanding arms, wherein said distributed force is distributed to said fourth and fifth gemstones via said second pair of upstanding arms.

12. The device of claim 11 wherein said third pair of upstanding arms are rigid buttressing arms resisting said distributed force acting on said fourth and fifth gemstones.

13. The device of claim 1 wherein said second pair of upstanding arms are flexible, and wherein a third pair of upstanding arms are mounted at base ends thereof to said pair of shanks so as to be disposed, one on each said shank, on opposite sides of said second pair of upstanding arms so as to form a second pair of gemstone receiving cavities adjacent to said first pair of gemstone receiving cavities, on opposite sides of said second pair of upstanding arms, between said second and third pairs of upstanding arms, and wherein fourth and fifth gemstones are mounted in said second pair of gemstone receiving cavities in compression between said second and third pairs of upstanding arms, wherein said distributed force is distributed to said fourth and fifth gemstones via said second pair of upstanding arms.

14. The device of claim 13 wherein said third pair of upstanding arms are rigid buttressing arms resisting said distributed force acting on said fourth and fifth gemstones.

15. The device of claim 1 wherein opposed facing surfaces of said pair of upstanding flexible arms are concavely cupped to conformally mate with correspondingly shaped edges of said keystone.

16. The device of claim 15 wherein oppositely disposed surfaces, opposite to said opposed facing surfaces, are concavely cupped in opposed facing relation to gemstone supporting surfaces of said second pair of upstanding arms supporting said second and third gemstones, and wherein said gemstone supporting surfaces are concavely cupped to conformally mate with correspondingly shaped edges of said second and third gemstones.

* * * * *